US008942612B2

(12) United States Patent
Tanaka

(10) Patent No.: US 8,942,612 B2
(45) Date of Patent: Jan. 27, 2015

(54) IMAGE HEATING APPARATUS

(71) Applicant: Canon Kabushiki Kaisha, Tokyo (JP)

(72) Inventor: Kenichi Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 79 days.

(21) Appl. No.: 13/681,987

(22) Filed: Nov. 20, 2012

(65) Prior Publication Data

US 2013/0140141 A1 Jun. 6, 2013

(30) Foreign Application Priority Data

Dec. 1, 2011 (JP) ..... 2011-264059

(51) Int. Cl.
*G03G 15/20* (2006.01)

(52) U.S. Cl.
CPC ..... *G03G 15/2003* (2013.01); *G03G 15/2017* (2013.01); *G03G 2215/2019* (2013.01)
USPC ..... 399/330

(58) Field of Classification Search
CPC ..... G03G 15/2053; G03G 2215/2019
USPC ..... 399/328, 329, 330
See application file for complete search history.

(56) References Cited

U.S. PATENT DOCUMENTS

| | | | | |
|---|---|---|---|---|
| 7,107,001 | B2 * | 9/2006 | Kameda | 399/328 |
| 7,570,909 | B2 * | 8/2009 | Asakura et al. | 399/328 |
| 7,577,389 | B2 * | 8/2009 | Ishii et al. | 399/328 |
| 7,725,047 | B2 | 5/2010 | Maeda et al. | |
| 2006/0245796 | A1 | 11/2006 | Wu et al. | |
| 2007/0264059 | A1 | 11/2007 | Maeda et al. | |
| 2009/0092422 | A1 | 4/2009 | Kagawa | |
| 2012/0027476 | A1 | 2/2012 | Tanaka | |

FOREIGN PATENT DOCUMENTS

| | | | |
|---|---|---|---|
| JP | 2004-198659 | A | 7/2004 |
| JP | 2007-304440 | A | 11/2007 |
| JP | 2008-197576 | A | 8/2008 |
| JP | 2010-134072 | A | 6/2010 |
| JP | 2010134072 | A * | 6/2010 |

OTHER PUBLICATIONS

European Search Report dated Jun. 23, 2014, issued in European Application No. 12194745.1-1560.

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image heating apparatus includes: first and second rotatable members configured to heat an image on a recording material at a nip therebetween; an endless belt configured to heat the first rotatable member in contact with an outer surface of the first rotatable member; and first and second rollers configured to rotatably support the endless belt from an inside of the endless belt. A heating portion by the endless belt is formed from a position where the endless belt is contacted to the first rotatable member by the first roller to a position where the endless belt is contacted to the first rotatable member by the second roller along a rotational direction of the first rotatable member. A pressure between the second roller and the first rotatable member is larger than a pressure between the first roller and the first rotatable member.

24 Claims, 7 Drawing Sheets

IMAGE HEATING APPARATUS

FIELD OF THE INVENTION AND RELATED ART

The present invention relates to an image heating apparatus for heating an image on a recording material. The image heating apparatus can be used in an image forming apparatus such as a copying machine, a printer, a facsimile machine, or a multi-function machine having a plurality of functions of these machines.

In recent years, the image forming apparatus such as the copying machine, the printer, or the multi-function machine is required to realize an increase in speed, image quality improvement, colorization, energy saving, and the like. Further, the image forming apparatus is also required to realize compatibility with multimedia, such as various recording materials including thick paper, roughened paper, embossed paper, coated paper and the like, and high productivity (print number per unit time).

In the image forming apparatus to which an electrophotographic type is applied, in order to improve productivity,. particularly with respect to a recording material having a large basis weight, it is preferable that a heating performance of a fixing device (image heating apparatus) is improved. This is because the heat quantity required to fix the image on the recording material having the large basis weight (e.g., the thick paper) is larger than that for a recording material having a small basis weight (e.g., thin paper).

Japanese Laid-Open Patent Application (JP-A) 2004-198659 proposes that a fixing device constituted by a fixing member and a pressing member is provided with an external heating device for externally heating the fixing member to effect temperature compensation of the fixing member.

Specifically, in this external heating device, a belt member (endless belt) is urged against an outer surface of the fixing member by a plurality of stretching rollers, each incorporating a halogen lamp, so that a wide heating portion is formed along a peripheral direction of the fixing member. As a result, the heat of the halogen lamp is conducted from the belt member to the fixing member via the stretching rollers, so that the surface temperature of the fixing member is intended to be prevented from decreasing.

However, when a close-contact property (adhesiveness) between the belt member and the fixing member is insufficient at the heating portion, the heat transfer efficiency from the belt member to the fixing member becomes poor, so that there is the possibility of the occurrence of a problem such that the temperature-compensating function for the fixing member cannot be sufficiently achieved.

SUMMARY OF THE INVENTION

A principal object of the present invention is to provide an image heating apparatus capable of sufficiently perform a temperature-compensating function by a belt member.

According to an aspect of the present invention, there is provided an image heating apparatus comprising: first and second rotatable members configured to heat an image on a recording material at a nip therebetween; an endless belt configured to heat the first rotatable member in contact with an outer surface of the first rotatable member; and first and second rollers configured to rotatably support the endless belt from an inside of the endless belt, wherein a heating portion by the endless belt is formed from a position where the endless belt is contacted to the first rotatable member by the first roller to a position where the endless belt is contacted to the first rotatable member by the second roller along a rotational direction of the first rotatable member, and wherein the pressure between the second roller and the first rotatable member is larger than a pressure between the first roller and the first rotatable member.

According to another aspect of the present invention, there is provided an image heating apparatus comprising: first and second rotatable members configured to heat an image on a recording material at a nip therebetween; an endless belt configured to heat the first rotatable member in contact with an outer surface of the first rotatable member; and first and second rollers configured to rotatably support the endless belt and configured to urge the endless belt toward the first rotatable member, wherein the second roller is provided downstream of the first roller with respect to a rotational direction of the first rotatable member, wherein the pressure between the second roller and the first rotatable member is larger than the pressure between the first roller and the first rotatable member.

According to another aspect of the present invention, there is provided an image heating apparatus comprising: first and second rotatable members configured to heat an image on a recording material at a nip therebetween; an endless belt configured to heat the first rotatable member in contact with an outer surface of the first rotatable member; and first and second rollers configured to rotatably support the endless belt from an inside of the endless belt, wherein the first and second rollers are provided so that a heating portion by the endless belt is formed from a position where the endless belt is contacted to the first rotatable member by the first roller to a position where the endless belt is contacted to the first rotatable member by the second roller along a rotational direction of the first rotatable member, wherein the feeding force by which the endless belt is fed between the second roller and the first rotatable member is larger than the feeding force by which the endless belt is fed between the first roller and the first rotatable member.

According to a further aspect of the present invention, there is provided an image heating apparatus comprising: first and second rotatable members configured to heat an image on a recording material at a nip therebetween; an endless belt configured to heat the first rotatable member in contact with an outer surface of the first rotatable member; and first and second rollers configured to rotatably support the endless belt and configured to urge endless belt toward the first rotatable member, wherein the second roller is provided downstream of the first roller with respect to a rotational direction of the first rotatable member, wherein the feeding force by which the endless belt is fed between the second roller and the first rotatable member is larger than the feeding force by which the endless belt is fed between the first roller and the first rotatable member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
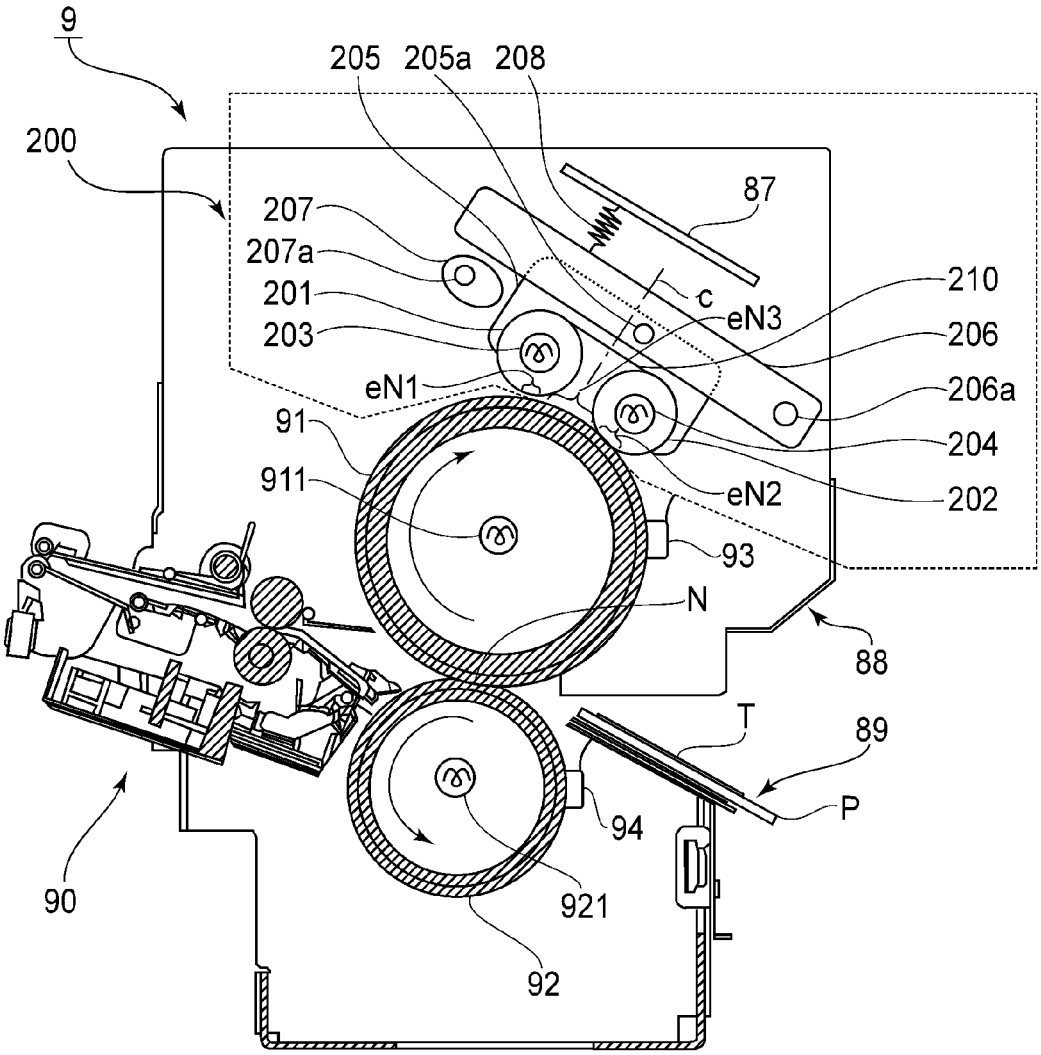
FIG. 1 is a sectional view showing a fixing device in First Embodiment of the present invention.
Figure 2:
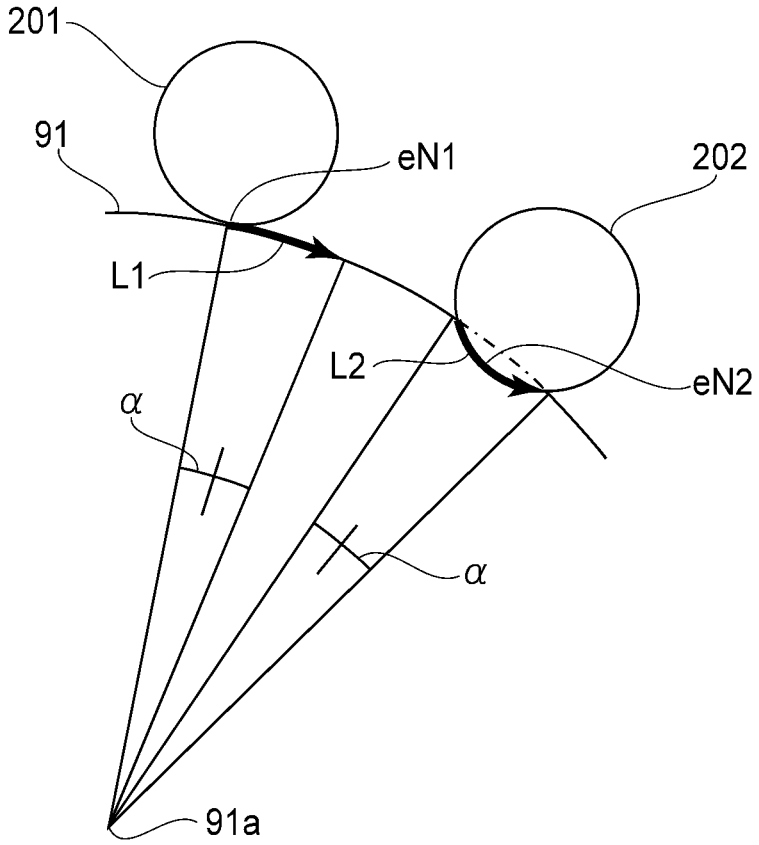
FIG. 2 is a schematic view for illustrating the reason why a tension is generated at an upstream side contact portion and a downstream side contact portion.
Figure 7:
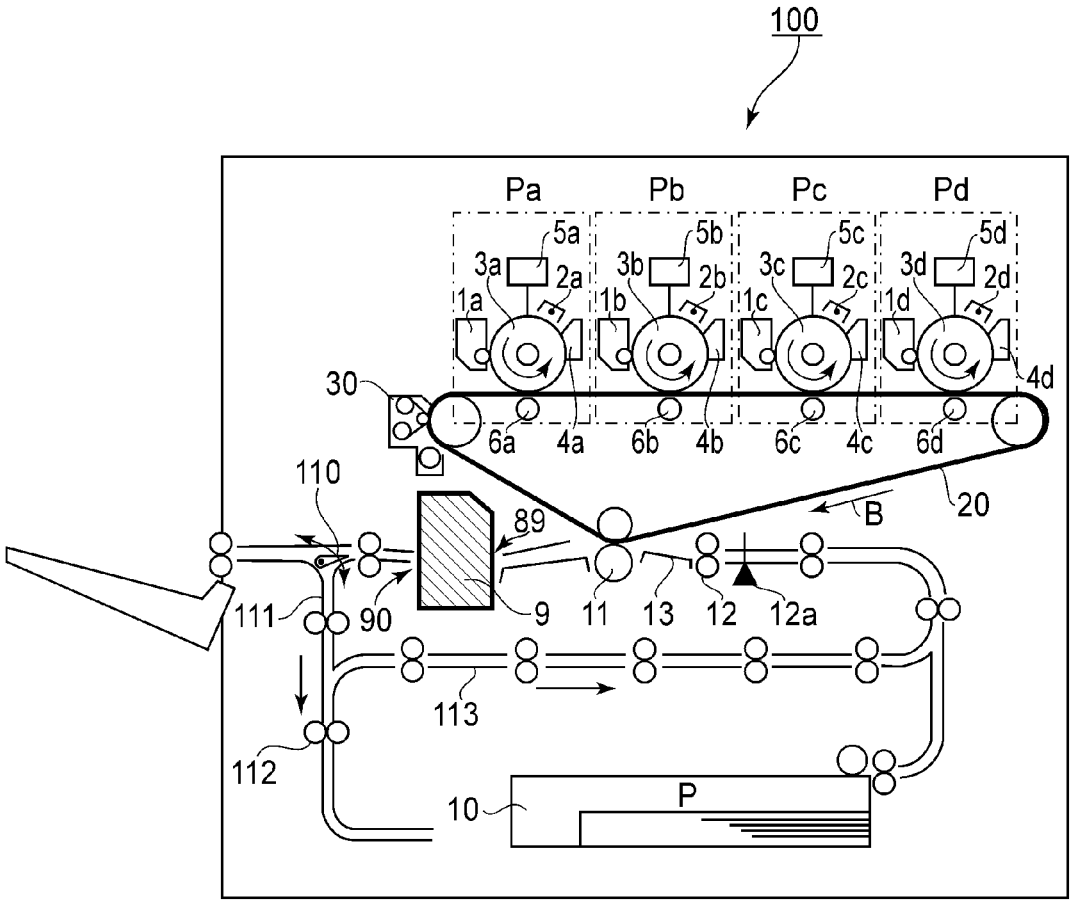
FIG. 7 is a sectional view showing a general structure of an image forming apparatus in the present invention.

Hereinbelow, embodiments of the present invention will be described specifically with reference to the drawings. FIG. 7 is a sectional view showing the general structure of an image forming apparatus in the present invention, FIG. 1 is a sectional view showing a fixing device in a First Embodiment of the present invention, and FIG. 2 is a schematic view for illustrating the reason why tension is generated at an upstream side contact portion and a downstream side contact portion.

In the following embodiments, as an example of an image heating apparatus according to the present invention, the fixing device for fixing an unfixed image on a recording material will be described but use of the image heating apparatus is not limited thereto. For example, the image heating apparatus according to the present invention can be applied to a heating device for adjusting a surface property of an image by heating and pressing the recording material on which a fixed image or a temporarily fixed image is carried, or the like device.

<First Embodiment>

(Image Forming Mechanism)

First, an image forming mechanism of an image forming apparatus 100 in the present invention will be described with reference to FIG. 7. The image forming apparatus 100 is a full-color laser beam printer of a tandem type in which image forming portions of Pa for yellow, Pb for magenta, Pc for cyan, and Pd for black are provided.

As shown in FIG. 7, in the image forming apparatus 100, first to fourth image forming portions Pa, Pb, Pc and Pd are juxtaposed and toner images of different colors (yellow, magenta, cyan and black) are formed through a process including latent image formation, development and transfer. The image forming portions Pa, Pb, Pc and Pd include dedicated image bearing members, i.e., electrophotographic photosensitive drums 3*a*, 3*b*, 3*c* and 3*d*, respectively, in this embodiment, and on each of the drums 3*a*, 3*b*, 3*c* and 3*d*, an associated color toner image is formed. Adjacently to the respective drums 3*a*, 3*b*, 3*c* and 3*d*, an intermediary transfer belt 20 is provided. The respective color toner images formed on the drums 3*a*, 3*b*, 3*c* and 3*d* are primary-transferred onto the intermediary transfer belt 20 and then are transferred onto a recording material P at a secondary transfer portion. Further, the recording material P on which the toner images are transferred is subjected to fixing of the toner images by a fixing device 9 under heat and pressure and thereafter is discharged to the outside of the image forming apparatus as a recording image-formed product.

At peripheries of the drums 3*a*, 3*b*, 3*c* and 3*d*, drum chargers 2*a*, 2*b*, 2*c* and 2*d*, developing devices 1*a*, 1*b*, 1*c* and 1*d*, primary transfer chargers 26*a*, 26*b*, 26*c* and 26*d* and cleaners 4*a*, 4*b*, 4*c* and 4*d* are respectively provided. Further, at an upper portion in the image forming apparatus 100, laser scanners 5*a*, 5*b*, 5*c* and 5*d* are respectively provided.

In each of the laser scanners 5*a*, 5*b*, 5*c* and 5*d*, unshown light source device and an unillustrated polygon mirror are provided. These laser scanners 5*a* to 5*d* rotate and scan the polygon mirrors with laser light emitted from the light source devices and then deflect fluxes of the scanning light by reflection mirrors. Then, the light fluxes are focused on generating lines of the photosensitive drums 3*a* to 3*d* by fθ lenses (not shown) to expose the photosensitive members to light, so that latent images, depending on image signals are formed on the photosensitive drums 3*a* to 3*d*.

In the developing devices 1*a*, 1*b*, 1*c* and 1*d*, as developers, toners of yellow, magenta, cyan and black, respectively, are filled in a predetermined amount by unshown supplying devices. The developing devices 1*a*, 1*b*, 1*c* and 1*d* develop the latent images on the photosensitive drums 3*a*, 3*b*, 3*c* and 3*d*, respectively, to visualize the latent images as a yellow toner image, a magenta toner image, a cyan toner image and a black toner image, respectively.

The intermediary transfer belt 20 is rotationally driven in a direction indicated by an arrow in FIG. 7 at the same peripheral speed as those of the photosensitive drum 3*a*, 3*b*, 3*c* and 3*d*. The yellow toner image for a first color formed and carried on the photosensitive drum 3*a* is intermediary-transferred onto an outer peripheral surface of the intermediary transfer belt 20 by pressure and an electric field formed by a primary transfer bias applied to the intermediary transfer belt 20 in a process in which the yellow toner image passes through a nip between the photosensitive drum 3*a* and the intermediary transfer belt 20. A secondary transfer roller 11 is shaft-supported in parallel correspondingly to the intermediary transfer belt 20 and is disposed in contact with a lower surface portion of the intermediary transfer belt 20. To the secondary transfer roller 11, a desired secondary transfer bias is applied by a secondary transfer bias voltage source.

A synthetic color toner image obtained by transferring the color toner images onto the intermediary transfer belt 20 in a superimposed manner is transferred onto the recording material P in the following manner. That is, the recording material P is fed from a sheet feeding cassette 10 and passes through a registration roller 12 and passes through a front transfer guide 13 to be conveyed into a contact nip between the intermediary transfer belt 20 and the secondary transfer roller 11 with predetermined timing and at the same time the secondary transfer bias is applied from the bias voltage source. By this secondary transfer bias, the synthetic color toner image is transferred from the intermediary transfer belt 20 onto the recording material P. Incidentally, a detection sensor 12*a* detects that the recording material P reaches the registration roller 12. Similarly as in the case of the yellow toner image for the first color, a magenta toner image for a second color, a cyan toner image for a third color and a black toner image for a fourth color are successively transferred in a superimposed manner onto the intermediary transfer belt 20, so that the synthetic color toner image corresponding to an objective color image is formed. The synthetic color toner image is formed while leaving certain margins from four edges of the recording material P.

Transfer residual toners remaining on the photosensitive drums 3*a*, 3*b*, 3*c* and 3*d* after primary transfer is ended are removed from the drums by the cleaners 4*a*, 4*b*, 4*c* and 4*d*, respectively, and then the photosensitive drums 3*a*, 3*b*, 3*c* and 3*d* prepare for subsequent latent image formation. Foreign matter, such as toner and the like, which remain on the intermediary transfer belt 20, are wiped with a cleaning web (nonwoven fabric) 19 by bringing the cleaning web 19 into contact to the surface of the intermediary transfer belt 20.

Then, the recording material P subjected to the toner image transfer is successively introduced into the fixing device 9, by which heat and pressure are applied to the recording material P to fix the toner image on the recording material P.

In the case of both-side (surface) printing, the recording material P fed from the sheet feeding cassette 10 passes through the registration roller 12, the front-transfer guide 13 and the contact nip between the intermediary transfer belt 20 and the secondary transfer roller 11. Then, the recording material after being subjected to one-side (surface) fixing by the fixing device 9 is introduced into a reverse path 111 via a switched switching member 110.

Thereafter, the recording material P is reversed by a reversing roller 112 and then is guided into a both-side path 113. Then, the recording material P passes again the registration roller 12, the front-transfer guide 13, and the contact nip between the intermediary transfer belt 20 and the secondary transfer roller 11 to be subjected to the transfer on a second surface (the other surface) and is subjected to fixing by the fixing device 9 to complete the both-side fixing. Further, the direction of the switching member 110 is switched during the both-side printing of the recording material P, and the recording material P subjected to the both-side fixing is discharged to the outside of the image forming apparatus 100 as a recording image-formed product.

(Fixing device)

Next, the fixing device 9 as the image heating apparatus according to the present invention will be described specifically with reference to FIG. 1. As described above, the image forming apparatus 100 includes the image forming portions Pa to Pd for forming the toner images on the recording material P and the fixing device 9 for fixing the toner images, on the recording material P, formed on the recording material P by the image forming portions Pa to Pd. The image heating apparatus of the present invention is applied to the fixing device 9.

The fixing device 9 constitutes, as shown in FIG. 1, the image heating apparatus for heating a fixing roller 91, which forms a fixing nip N, and an unfixed image (toner image) T carried on the recording material P is to be passed through the fixing nip N. The fixing device 9 includes the fixing roller 91 as a first rotatable member (image heating member), a pressing roller 92 as a second rotatable member (pressing member) press contacting the fixing roller 91 to form the nip N, and an external heating unit 200. The fixing device 9 passes the unfixed toner image T on the recording material P through the fixing nip N to fix the unfixed toner image T on the recording material P.

The fixing device 9 includes a casing 88 for accommodating the above-described external heating unit 200, the fixing roller 91, the pressing roller 92, and the like. The fixing device 9 includes a recording material introducing portion 89 upstream of the casing 88 with respect to a recording material conveyance direction and includes a recording material discharging portion 90 downstream of the casing 88 with respect to the recording material conveyance direction.

The fixing roller 91 is rotationally driven by an unshown driving source in an arrow direction at a predetermined speed, e.g., at a peripheral speed of 500 mm/sec. The fixing roller (rotatable heating member) 91 specifically includes a cylindrical metal core (of aluminum in this embodiment) of 77 mm in outer diameter, 6 mm in thickness and 350 mm in length. The metal core is coated with a 1.5 mm-thick heat-resistant elastic layer of silicone rubber (JIS-A hardness: 20 degrees) in this embodiment.

The elastic layer is coated with a 50 μm-thick heat-resistant parting layer 101*c* of fluorine-containing resin (PFA (polytetrafluoroethylene) tube in this embodiment).

Inside the metal core of the fixing roller 91, a halogen heater 911 with rated power of, e.g., 1200 W, is provided as a heating means, so that the fixing roller 91 is internally heated so that the surface temperature of the fixing roller 91 is a predetermined temperature.

The surface temperature of the fixing roller 91 is detected by a thermistor 93 as a temperature detecting means contacting the fixing roller 91. The halogen heater 911 is controlled by an unshown controller so that the surface temperature is a predetermined target temperature, e.g., of 200° C.

The pressing roller 92 is urged against the fixing roller 91 at a predetermined pressure by an unshown urging means, thus forming the fixing nip N between itself and the fixing roller 91. The pressing roller 92 is rotated by rotation of the fixing roller 91 rotated by an unshown driving portion at a predetermined peripheral speed (e.g., 500 mm/sec).

Specifically, the pressing roller 92 includes a cylindrical metal core (of aluminum in this embodiment) of 54 mm in outer diameter, 5 mm in thickness and 350 mm in length. The metal core is coated with a 3 mm-thick heat-resistant elastic layer of silicone rubber (JIS-A hardness: 15 degrees) in this embodiment.

The elastic layer is coated with a 100 μm-thick heat-resistant parting layer of fluorine-containing resin (PFA tube in this embodiment).

Inside the metal core of the pressing roller 92, a halogen heater 921 with rated power of, e.g., 300 W, is provided as a heating means, so that the pressing roller 92 is internally heated so that the surface temperature of the pressing roller 92 is a predetermined temperature.

The surface temperature of the pressing roller 92 is detected by a thermistor 94 as a temperature detecting means contacting the pressing roller 92. The halogen heater 921 is controlled by an unshown controller so that the surface temperature is a predetermined target temperature, e.g., of 130° C.

(External Heating Device)

Next, the external heating unit 200 as an external heating device will be described specifically. That is, as shown in FIG. 1, on an outer peripheral surface of the fixing roller 91, an external heating belt 210 as an external heating member (belt member or endless belt) is provided. The external heating belt 210 is stretched by an upstream side supporting roller 201 as a first supporting member and a downstream side supporting roller 202 as a second supporting member. The external heating belt 210 is constituted in an endless shape so as to contact the fixing roller 91.

That is, the upstream side supporting roller 201 is upstream of the downstream side supporting roller 202, and the downstream side supporting roller 202 is downstream of the upstream side supporting roller 201, upstream and downstream being determined with respect to a rotational direction of the fixing roller 91. The upstream side supporting roller 201 and the downstream side supporting roller 202 perform the function of urging the external heating belt 210 toward the fixing roller 91. The external heating belt 210 (stretched by the upstream side supporting roller 201 and the downstream side supporting roller 202) is configured to be rotated (together with the fixing roller 91) by rotation of the fixing roller 91.

Inside the casing 88, an urging arm 206 is supported by a rotation supporting shaft 206*a* located in a right side in FIG. 1 so that the urging arm 206 is rotatable in the clockwise direction and the counterclockwise direction in FIG. 1. In FIG. 1, with respect to a front-rear direction, at a substantially central position of the urging arm 206 rotationally supported by the rotation supporting shaft 206*a*, a roller supporting frame 205 is rotatably supported via a rotation supporting shaft (rotation supporting point) 205*a*. The roller supporting frame 205 constitutes a holding mechanism for integrally holding the upstream side supporting roller 201 and the downstream side supporting roller 202. The rotation supporting shaft 205*a* is provided closer to the downstream side supporting roller 202 (downstream side supporting member) than the center position of the roller supporting frame 205.

Further, in the casing 88, an urging mechanism for urging the upstream side supporting roller 201 and the downstream side supporting roller 202 toward the fixing roller 91 is provided. Specifically, above the urging arm 206 in the casing 88, a spring supporting portion 87 is fixed, and an urging spring 208 such as a compression spring or the like is compressedly provided between the spring supporting portion 87 and the urging arm 206. The urging arm 206 is configured to rotatably support the roller supporting frame 205 with the rotation supporting shaft 205*a* as a supporting point and is also configured to urge the roller supporting frame 205 toward the fixing roller 91.

Further, a contact-and-separation mechanism for moving the external heating belt 200 toward and away from the fixing roller 91 is provided. Specifically, in the neighborhood of the roller support supporting roller 201 side, an elliptical urging cam 207 is supported to be rotated about a rotation shaft 207*a*. When the urging cam 207 is rotated, the urging arm 206 is rotationally operated, against an urging force of the urging spring 208, about the rotation supporting shaft 206*a* fixed to the casing 88, and therefore the roller supporting frame 205 is rotationally moved, about the rotation supporting shaft 205 a, relative to the urging arm 206. As a result, the contact-and-separation mechanism is constituted so that the upstream side supporting roller 201 and the downstream side supporting roller 202 are movable toward and away from (contactable with and retractable from) the fixing roller 91.

By the constitution described above, the urging force of the urging spring 208 is applied to the external heating belt 210 via the urging arm 206 and the roller supporting frame 205, so that the external heating belt 210 is urged against the fixing roller 91 at a predetermined pressure (total pressure).

The pressure generated by the urging spring 208 concentrates at the rotation supporting shaft 205*a* to which the urging arm 206 and the roller supporting frame 205 are connected. Then, the pressure (total pressure) applied to the rotation supporting shaft 205*a* is distributed in the upstream side supporting roller 201 and the downstream side supporting roller 202. As a result, an upstream side contact portion eN1 where the external heating belt 200 is pressed between the fixing roller 91 and the upstream side supporting roller 201 and a downstream side contact portion eN2 where the external heating belt 200 is pressed between the fixing roller 91 and the downstream side supporting roller 202 are formed. Further, an external heating contact portion eN3 where the external heating belt 200 is contacted to the fixing roller 91 between the upstream side contact portion eN1 and the downstream side contact portion eN2 is formed.

For example, each of the upstream side supporting roller 201 and the downstream side supporting roller 202 includes a cylindrical metal core (of aluminum in this embodiment) of 30 mm in outer diameter, 2 mm in thickness and 360 mm in length. The metal core is coated with a 20 μm-thick heat-resistant parting layer of a fluorine-containing resin material (a PFA tube in this embodiment).

The external heating belt 210 has a layer of a base material formed, of metal such as stainless steel or nickel or of resin such as polyimide, and the layer is 60 mm in outer diameter, 100 μm in thickness and 350 μm in width. The external heating belt 210 is, in order to prevent deposition of the toner, coated with a 20 μm-thick heat-resistant sliding layer of a fluorine-containing resin material (a PFA tube in this embodiment).

Inside the metal cores of the upstream side supporting roller 201 and the downstream side supporting roller 202, as a heat generating element, halogen heaters 203 and 204 with rated power of, e.g., 1000 W, are provided. The halogen heaters 203 and 204 are disposed to heat the upstream supporting roller 201 and the downstream side supporting roller 202, respectively.

The external heating belt 210 is configured to be heated by the heated upstream side supporting roller 201 and the heated downstream side supporting roller 202 and is configured to heat the surface layer of the fixing roller 91 by contact with the fixing roller 91. Further, the rotation supporting shaft 205*a* is provided closer to the upstream side supporting roller 202 than the center position c of the roller supporting frame 205, whereby the external heating belt 210 is constituted so that a downstream side feeding force is larger than an upstream side feeding force. The upstream side feeding force is a force for feeding the external heating belt 210 at the upstream side contact portion eN1 where the fixing roller 91 and a portion of the external heating belt 210 supported by the upstream side supporting roller 201 contact each other. The downstream side feeding force is a force for feeding the external heating belt 210 at the downstream side contact portion eN2 where the fixing roller 91 and a portion of the external heating belt 210 supported by the downstream side supporting roller 202 contact each other.

The rotation supporting shaft 205*a* is disposed at the position closer to the downstream side supporting roller 202 than the upstream side supporting roller 201 and therefore the pressure of the urging spring 208 applied to the rotation supporting shaft 205*a* via the urging arm 206 is distributed as follows. That is, the pressure is distributed so that the pressure (total pressure) at which the downstream side supporting roller 202 is pressed toward the fixing roller 91 is higher than the pressure (total pressure) at which the upstream side supporting roller 201 is pressed toward the fixing roller 91.

Each of the upstream side supporting roller 201 and the downstream side supporting roller 202 comprises the metal roller having a small diameter compared with the fixing roller 91, and therefore when the roller 201 (or 202) is pressed toward the fixing roller 91, the roller 201 (or 202) deforms and enters the elastic layer of the fixing roller 91. At this time, the downstream side supporting roller 202 is pressed toward the fixing roller 91 at the pressure larger than that of the upstream side supporting roller 201, and therefore the downstream side supporting roller 202 is pressed toward the fixing roller 91 while deforming the elastic layer of the fixing roller 91 to a larger degree.

At this time, the external heating belt 210 is rotated by the rotation of the fixing roller 91. For this reason, as shown in FIG. 2, when the fixing roller 91 is rotated by the same angle α about a rotation axis 91*a*, as a rotation center, which coincides with a position of the halogen heater 911, the external heating belt is configured as follows. That is, the distance L2 through which the external heating belt 210 is fed at the downstream side contact portion eN2 is longer than the distance L1 through which the external heating belt 210 is fed at the upstream side contact portion eN1.

Therefore, the feeding force (downstream side feeding force) at the downstream side contact portion eN2 is larger than the feeding force (upstream side feeding force) at the upstream side contact portion eN1, so that a tension is generated in the external heating belt 210 at the position of the external heating contact portion eN3. As a result, a force acts in a direction in which the external heating belt 210 is intimately contacted to the fixing roller 91, and thus a close contact property between the external heating belt 210 and the fixing roller 91 is enhanced, so that the heat transfer efficiency from the external heating belt 210 to the fixing roller 91 is remarkably improved.

In this embodiment, the force for feeding the external heating belt 210 at the position of the downstream side contact portion eN2 located downstream of the upstream side contact portion eN1 with respect to a feeding direction of the external heating belt 210 is made larger than the force for feeding the external heating belt 210 at the position of the upstream side contact portion eNl. That is, the pressure at which the downstream side supporting roller 202 is press-contacted to the fixing roller 91 is made larger than the pressure at which the upstream side supporting roller 201 is press-contacted to the fixing roller 91, so that the downstream side supporting roller 202 can enter the fixing roller 91 to a larger degree.

For this reason, a feeding force difference is generated between the upstream side contact portion eN1 and the downstream side contact portion eN2, so that the tension is generated in the external heating belt 210. As a result, without separately adding an urging member, a tension roller and the like, it is possible to enhance the close contact property of the external heating belt 210 with the fixing roller 91 and thus to improve the heat transfer efficiency from the external heating belt 210 to the fixing roller 91.

<Second Embodiment>

Figure 3:
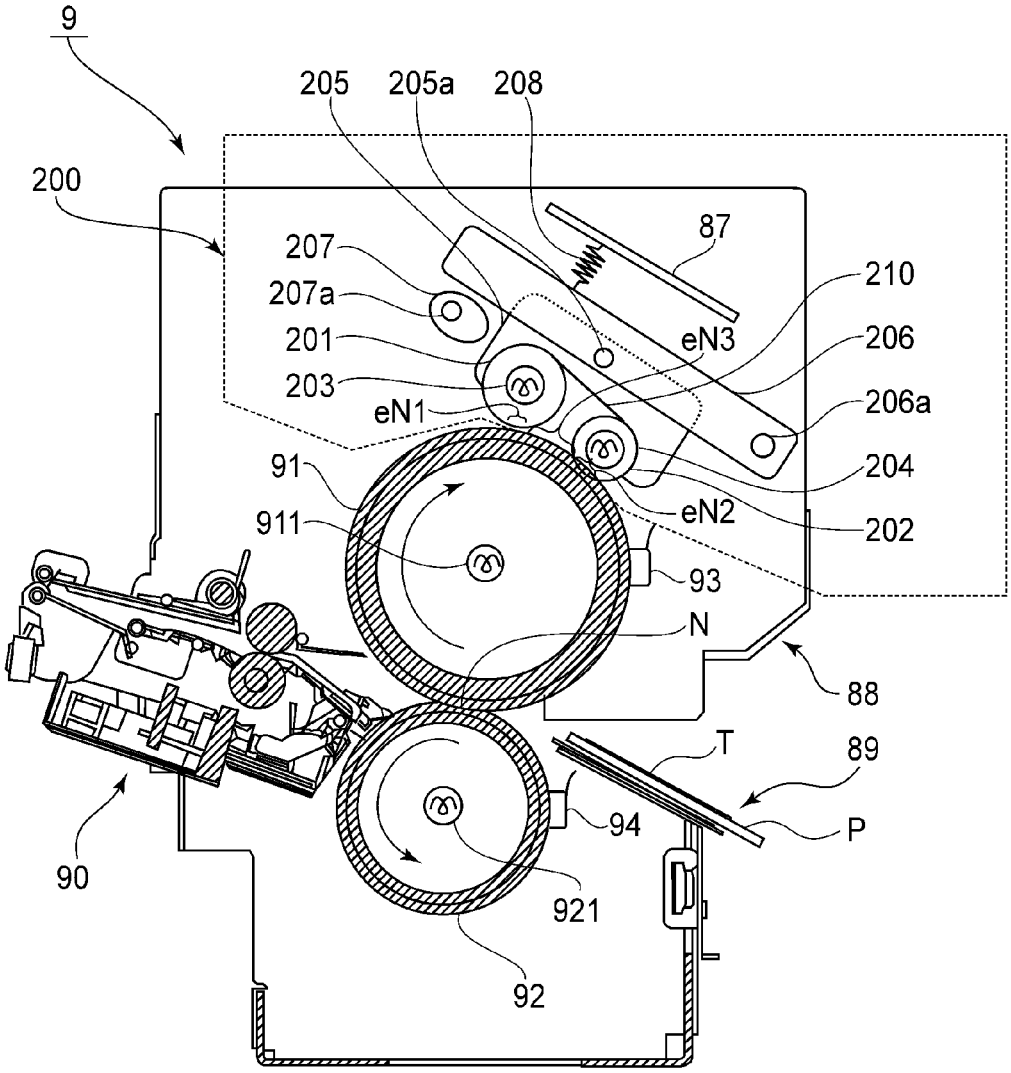
FIGS. 3, 4 and 5 are sectional views showing fixing devices in Second, Third and Fourth Embodiments, respectively, of the present invention.

A second Embodiment of an image heating apparatus according to the present invention will be described with reference to FIG. 3 in detail. Incidentally, the difference of this embodiment from the First Embodiment is only the constitution of the external heating unit 200, and therefore other constituent elements of the image forming apparatus 100 and the fixing device 9 will be omitted from description. Further, constituent elements similar to those in the First Embodiment are represented by the same reference numerals or symbols.

The external heating unit 200 in this embodiment is characterized in that the outer diameter of the downstream side supporting roller 202 for stretching the external heating belt 210 is smaller than the outer diameter of the upstream side supporting roller 201 for stretching the external heating belt 210. That is, in this embodiment, both of the supporting rollers 201 and 202 are urged toward the fixing roller 91 by the urging spring 208 with a uniform force while being integrally supported by the roller supporting frame 205. At the same time, the outer diameter of the downstream side supporting roller 202 is made smaller than the outer diameter of the upstream side supporting roller 201, so that the downstream side feeding force is made larger than the upstream side feeding force as described above.

By this constitution, the pressure (total pressure) applied from the upstream side supporting roller 201 to the fixing roller 91 and the pressure (total pressure) applied from the downstream side supporting roller 202 to the fixing roller 91 are made equal to each other. However, the downstream side supporting roller 202 is a smaller-diameter roller, and therefore the width of the downstream side contact portion eN2 becomes narrower than the width of the upstream side contact portion eN1, so that the pressure per unit area at an associated position is higher at the downstream side contact portion eN2 than at the upstream side contact portion eNl.

That is, the outer diameter of the downstream side supporting roller 202 is made smaller than that of the upstream side supporting roller 201, so that when both of the supporting rollers 201 and 202 are pressed toward the fixing roller 91 at the same pressure (total pressure), the downstream side supporting roller 202 enters the fixing roller 91 to a larger degree. For that reason, the feeding force by which the external heating belt 210 is fed by the downstream side supporting roller 202 becomes larger than that by which the external heating belt 210 is fed by the upstream side supporting roller 201, so that the above-described feeding force difference can be generated.

As a result, the downstream side supporting roller 202 is pressed toward the fixing roller 91 while deforming the elastic layer of the fixing roller 91 to a degree larger than that by the upstream side supporting roller 201. As a result, for the reason described in the First Embodiment, tension is generated between the upstream side contact portion eN1 and the downstream side contact portion eN2. For that reason, the tension is generated in the external heating belt 210 to enhance the close contact property of the external heating belt 210 with the fixing roller 91 at the external heating contact portion eN3, so that the heat transfer efficiency from the external heating belt 210 to the fixing roller 91 is remarkably improved.

In this embodiment, compared with the First Embodiment, the upstream side supporting roller 201 having a relatively larger diameter is pressed toward the fixing roller 91 to deform the fixing roller 91, so that the downstream side supporting roller 202 having the smaller diameter can deform the fixing roller 91 at a smaller pressure. For that reason, such an effect that damage on the fixing roller 91 can be alleviated and thus the lifetime of parts of the fixing roller 91 can be prolonged can also be obtained.

Further, in this embodiment, a constitution is employed in which the outer diameter of the supporting roller is changed, but a constitution in which a surface roughness of the supporting roller is changed may also be employed. Specifically, the surface roughness (friction coefficient) of the downstream side supporting roller is made larger than that of the upstream side supporting roller, so that the feeding force of the upstream side supporting roller can be made larger than that of the upstream side supporting roller.

Incidentally, in this embodiment, the rotation supporting shaft 205*a* of the roller supporting frame 205 is provided at a position equidistant from the upstream side supporting roller 201 and the downstream side supporting roller 202, but the following constitution can also be employed. That is, as described in the First Embodiment, by disposing the rotation supporting shaft 205*a* at the position closer to the downstream side supporting roller 202, the pressure at which the fixing roller 91 is pressed by the downstream side supporting roller 202 is made larger than that at which the fixing roller 91 is pressed by the upstream side supporting roller 201. As a result, it is possible to employ a constitution in which the roller supporting frame 205 is urged toward the fixing roller 91 by a force for urging the frame 205 toward the downstream side supporting roller 202 by the urging spring 208. For this reason, by providing a larger degree of the feeding force difference, the close contact property between the external heating belt 210 and the fixing roller 91 can be enhanced.

A third Embodiment of an image heating apparatus according to the present invention will be described with reference to FIG. 4 in detail. Incidentally, the difference of this embodiment from the First Embodiment is only the constitution of the external heating unit 200, and therefore other constituent elements of the image forming apparatus 100 and the fixing device 9 will be omitted from description. Further, constituent elements similar to those in the First Embodiment are represented by the same reference numerals or symbols.

Figure 4:
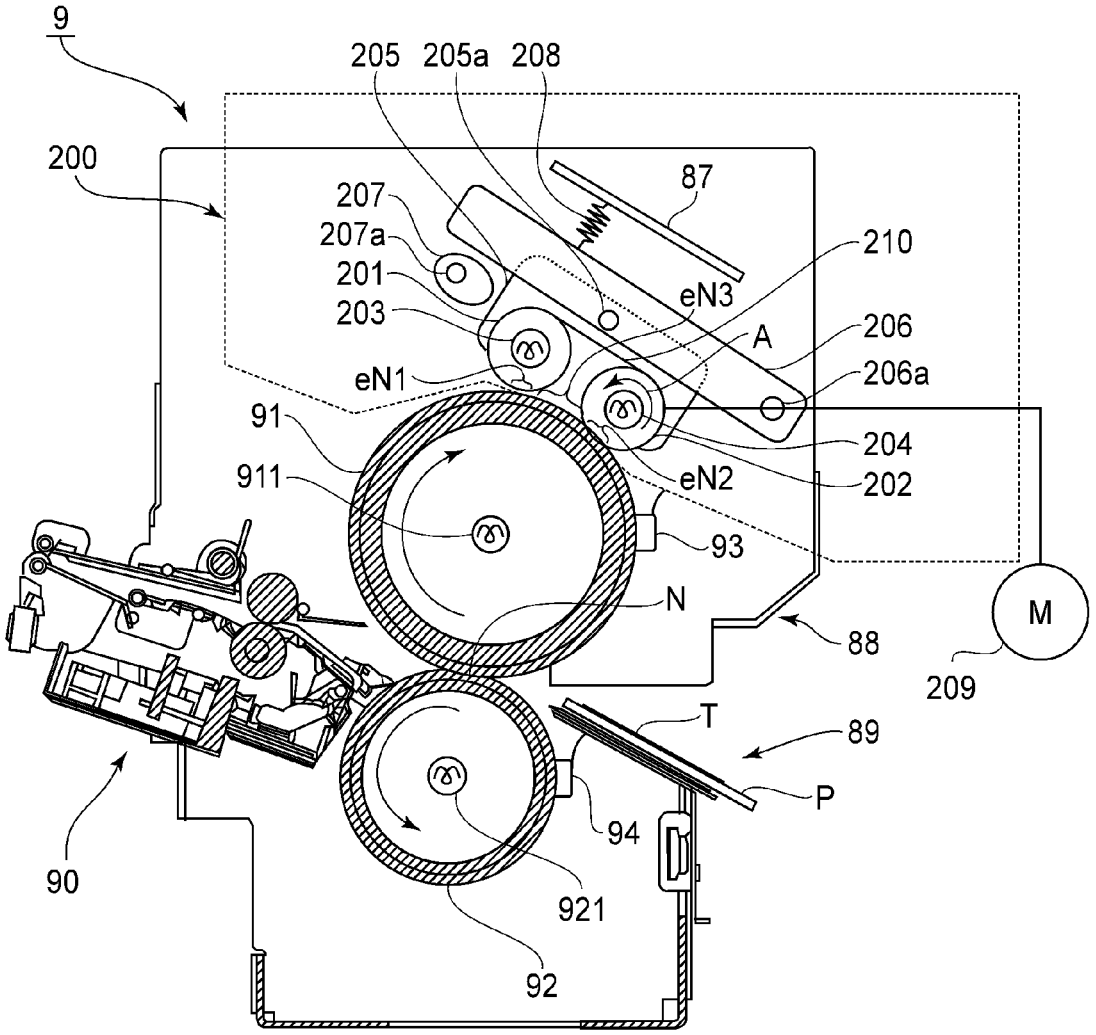

The external heating unit 200 in this embodiment is characterized in that a driving motor 209 for rotationally driving, in an arrow A direction in FIG. 4, the downstream side supporting roller 202 of the upstream side and downstream side supporting rollers 201 and 202 for stretching the external heating belt 210 is provided. That is, in this embodiment, a constitution in which the downstream side supporting roller 202 is driven by providing the driving motor (driving source) 209 for rotationally driving the downstream side supporting roller 202, and at the same time, the upstream side supporting roller 201 is rotated by the rotation of the downstream side supporting roller 202. As a result, the peripheral speed of the downstream side supporting roller 202 at the downstream side contact portion eN2 is made larger than that of the upstream side supporting roller 201 at the upstream side contact portion eN1, so that it becomes possible to make the above-described downstream side feeding force larger than the above-described upstream side feeding force.

By the constitution, the feeding force for feeding the external heating belt 210 by the downstream side supporting roller 202 at the position of the downstream side contact portion eN2 is larger than the feeding force for feeding the external heating belt 210 by the upstream side supporting roller 201 at the position of the upstream side contact portion eN1. For this reason, the tension is generated between the upstream side contact portion eN1 and the downstream side contact portion eN2, so that the tension is generated in the external heating belt 210. As a result, the external heating belt 210 is satisfactorily contacted intimately to the fixing roller 91 at the external heating contact portion eN3, so that the heat transfer efficiency from the external heating belt 210 to the fixing roller 91 can be improved.

In this embodiment, different from the First and Second Embodiments, the feeding force difference with respect to the external heating belt 210 is not generated by pressing the downstream side supporting roller 202 toward the fixing roller 91 to deform the elastic layer of the fixing roller 91. That is, a frictional force is generated by the speed difference between the downstream side supporting roller 202 and the inner peripheral surface of the external heating belt 210, thus generating the feeding force difference. For that reason, the degree of stress on the fixing roller 91 is small, so that it is possible to obtain such an effect that the degree of a decrease in lifetime of the parts due to scars and damage on the surface layer of the fixing roller 91 can be reduced.

Also in this embodiment, as described above, by disposing the rotation supporting shaft 205*a* at the position closer to the downstream side supporting roller 202, the pressure at which the fixing roller 91 is pressed by the downstream side supporting roller 202 can be made larger than that at which the fixing roller 91 is pressed by the upstream side supporting roller 201. As a result, by providing a larger degree of the feeding force difference, the close contact property between the external heating belt 210 and the fixing roller 91 can also be enhanced.

Incidentally, in this embodiment, the driving motor 209 for driving the downstream side supporting roller 202 is provided but this constitution is also similarly applicable to other embodiments. Also in these cases, an effect substantially similar to that in this embodiment can be achieved.

<Fourth Embodiment>

Figure 5:
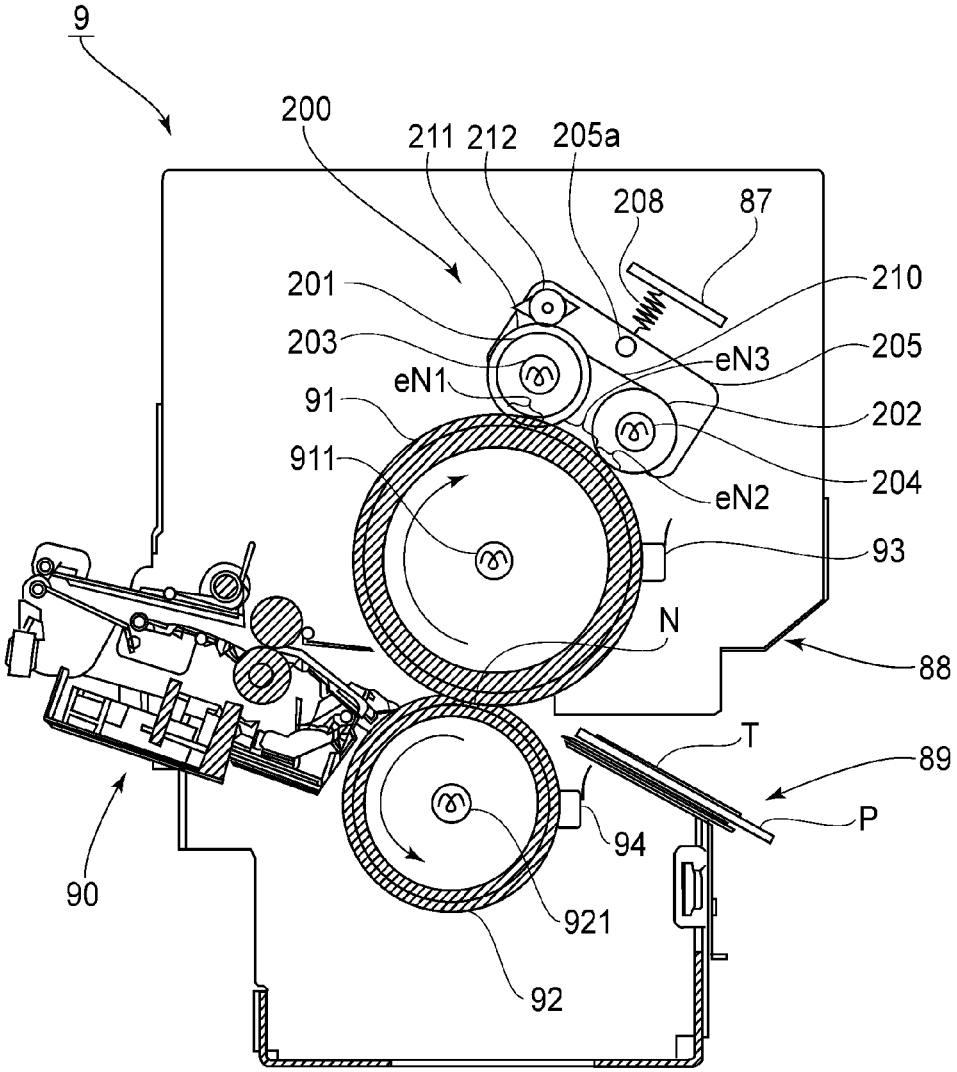
Figure 6:
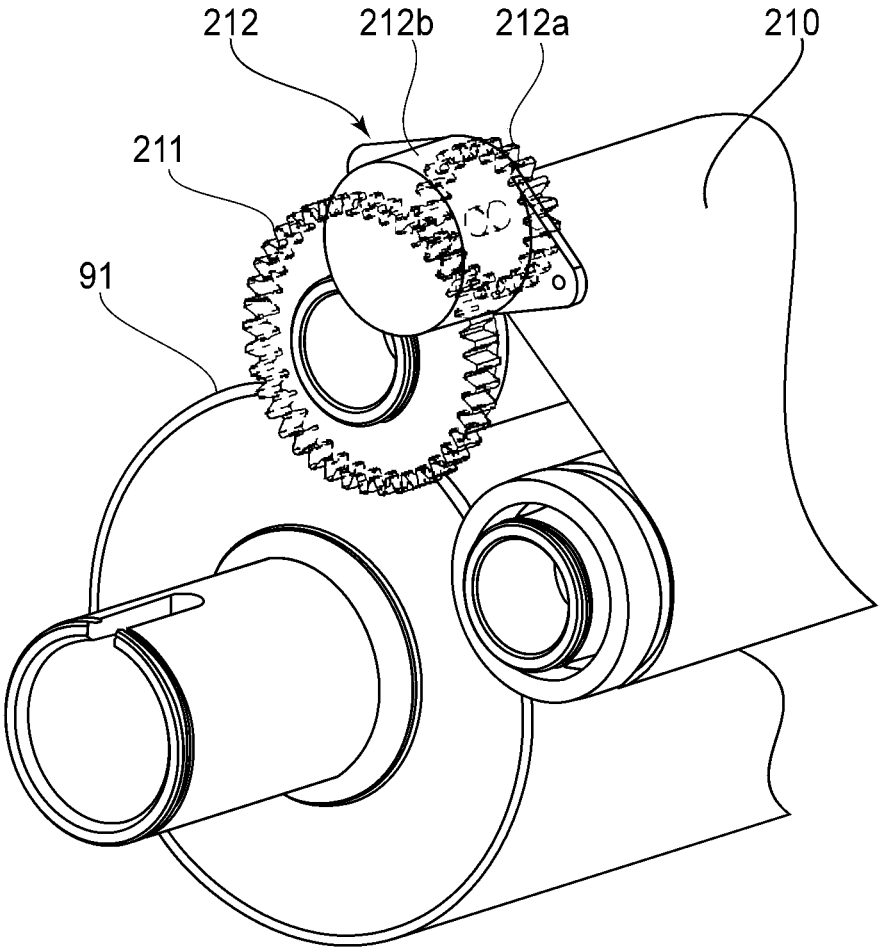
FIG. 6 is a perspective view showing a rotary damper of the fixing device and its neighborhood in Fourth Embodiment.

A fourth Embodiment of an image heating apparatus according to the present invention will be described with reference to FIGS. 5 and 6 in detail. FIG. 6 is a perspective view showing a rotary damper 212 for the fixing device 9 and its neighborhood in this embodiment, but the roller supporting frame 205 is omitted from illustration. Incidentally, the difference of this embodiment from the First Embodiment is only the constitution of the external heating unit 200, and therefore other constituent elements of the image forming apparatus 100 and the fixing device 9 will be omitted from description. Further, constituent elements similar to those in the First Embodiment are represented by the same reference numerals or symbols.

The external heating unit 200 in this embodiment was provided with the rotary damper 212 as an imparting mechanism for making the rotational resistance acting on the upstream side supporting roller 201 larger than that acting on the downstream side supporting roller 202. As a result, the above-described downstream side feeding force is made larger than the above-described upstream side feeding force.

That is, in this embodiment, the roller supporting frame 205 is urged toward the fixing roller 91 by directly receiving the urging force of the urging spring 208, without being applied via the urging arm 206, at the rotation supporting shaft 205a located at the substantially center position. The rotary damper 212 is fixed to the roller supporting frame 205 at the upstream side supporting roller 201 side, and a gear 212a on an axis of the rotary damper 212 is engaged with a transmission gear 211. The transmission gear 211 is fixed to either one of end portions of the shaft (axis) of the upstream side supporting roller 201 at the upstream side and downstream side supporting rollers 201 and 202 for stretching the external heating belt 210. The rotary damper imparts a damping force (braking force), to the transmission gear 211 via the gear 212*a*, generated by a viscosity resistance of oil filled inside a case 212*b*.

By the above constitution, when the external heating belt 210 is rotated by the rotational driving the fixing roller 91, the rotational resistance of the upstream side supporting roller 201 is increased by a damping (braking) effect of the rotary damper 212. As a result, the upstream side supporting roller 201 generates a frictional force with respect to a direction in which the rotational driving of the external heating belt 210 is prevented.

In this embodiment, a setting is made so that a load of, e.g., 2N.m is applied onto the shaft of the upstream side supporting roller 201 by the rotary damper 212. As a result, the upstream side supporting roller 201 constitutes the resistance to the feeding of the external heating belt 210, so that the rotational resistance of the downstream side supporting roller 202 is smaller than that of the upstream side supporting roller 201. For that reason, the above-described feeding force difference is generated and thus the tension is generated between the upstream side contact portion eN1 and the downstream side contact portion eN2, so that a force acts in a direction in which the external heating belt 210 is intimately contacted to the fixing roller 91 at the external heating contact portion eN3. As a result, the close contact property of the external heating belt 210 with the fixing roller 91 can be enhanced, so that the heat transfer efficiency from the external heating belt 210 to the fixing roller 91 can be improved.

Also in this embodiment, similar to the Third Embodiment, the feeding force difference is generated without deforming the elastic layer of the fixing roller 91 under the application of pressure from the downstream side supporting roller 202 toward the fixing roller 91, so that the degree of stress on the fixing roller 91 can be reduced. Further, in this embodiment, compared with the Third Embodiment, the constitution in which the rotary damper 212, not the driving motor 209, is added to the external heating unit 200 is employed. For this reason, there is no need to effect control of an actuator such as the driving motor 209, so that the above effect can be realized by a relatively simple constitution.

In this embodiment, the rotary damper 212 for imparting the rotational resistance to the upstream side supporting roller 201 is provided but this constitution is also similarly applicable to other embodiments.

Incidentally, the present invention is not limited to the above-described Embodiments but, e.g., materials can also be selected so that the frictional force of the downstream side supporting roller 202 with the external heating belt 210 is made larger than that of the upstream side supporting roller 201 with the external heating belt 210. Thus, by using the upstream side supporting roller 201 and the downstream side supporting roller 202 which are different in frictional force, the above-described feeding force difference is generated and thus the tension is generated between the upstream side contact portion eN1 and the downstream side contact portion eN2, so that an effect similar to those in other embodiments can be obtained.

In the embodiments described above, the constitution in which the external heating belt 210 is supported by the two rollers consisting of the upstream side supporting roller 201 and the downstream side supporting roller 202 is described, but the present invention is also applicable to a constitution in which the external heating belt 210 is supported by three or more rollers.

Further, various mechanisms mentioned in the above-described embodiments can be replaced with other known mechanisms within the scope of the present invention.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 264059/2011 filed Dec. 1, 2011, which is hereby incorporated by reference.

What is claimed is:

1. An image heating apparatus comprising:

first and second rotatable members configured to form a nip portion for heating an image on a recording material at a nip therebetween;

an endless belt configured to heat said first rotatable member in contact with an outer surface of said first rotatable member; and first and second rollers configured to rotatably support said endless belt from an inside of said endless belt, wherein a heating area in which said first rotatable member is heated by said endless belt is formed from a position where said endless belt is pressed to said first rotatable member by said first roller to a position where said endless belt is pressed to said first rotatable member by said second roller along a rotational direction of said first rotatable member, wherein a pressure between said second roller and said first rotatable member is larger than a pressure between said first roller and said first rotatable member, and wherein a feeding force by which said endless belt is fed between said second roller and said first rotatable member is larger than a feeding force by which said endless belt is fed between said first roller and said first rotatable member.

2. An image heating apparatus according to claim 1, further comprising an urging mechanism configured to urge said first and second rollers so that the pressure between said second roller and said first rotatable member is larger than the pressure between said first roller and said first rotatable member.

3. An image heating apparatus according to claim 1, further comprising:

a holding mechanism configured to hold said endless belt and said first and second rollers so as to be integrally movable;

a moving mechanism configured to move said holding mechanism so that said endless belt is movable toward and away from said first roller; and an urging mechanism configured to urge said moving mechanism so that the pressure between said second roller and said first rotatable member is larger than the pressure between said first roller and said first rotatable member.

4. An image heating apparatus according to claim 1, wherein said endless belt is configured to be rotated by rotation of said first rotatable member.

5. An image heating apparatus according to claim 1, wherein said first rotatable member has an elastic layer, and wherein a length, with respect to the rotational direction, of a region where said endless belt is nipped between said second roller and said first rotatable member is longer than a length, with respect to the rotational direction, of a region where said endless belt is nipped between said first roller and said first rotatable member.

6. An image heating apparatus according to claim 1, wherein said first rotatable member contacts and heats an unfixed image as the image to fix the unfixed image on the recording material.

7. An image heating apparatus comprising:

first and second rotatable members configured to heat an image on a recording material at a nip therebetween;

an endless belt configured to heat said first rotatable member in contact with an outer surface of said first rotatable member; and first and second rollers configured to rotatably support said endless belt and configured to urge said endless belt toward said first rotatable member, wherein said second roller is provided downstream of said first roller with respect to a rotational direction of said first rotatable member within said endless belt;

wherein a pressure between said second roller and said first rotatable member is larger than a pressure between said first roller and said first rotatable member, and wherein a feeding force by which said endless belt is fed between said second roller and said first rotatable member is larger than a feeding force by which said endless belt is fed between said first roller and said first rotatable member.

8. An image heating apparatus according to claim 7, further comprising an urging mechanism configured to urge said first and second rollers so that the pressure between said second roller and said first rotatable member is larger than the pressure between said first roller and said first rotatable member.

9. An image heating apparatus according to claim 7, further comprising:

a holding mechanism configured to hold said endless belt and said first and second rollers so as to be integrally movable;

a moving mechanism configured to move said holding mechanism so that said endless belt is movable toward and away from said first roller; and an urging mechanism configured to urge said moving mechanism so that the pressure between said second roller and said first rotatable member is larger than the pressure between said first roller and said first rotatable member.

10. An image heating apparatus according to claim 7, wherein said endless belt is configured to be rotated by rotation of said first rotatable member.

11. An image heating apparatus according to claim 7, wherein said first rotatable member has an elastic layer, and wherein a length, with respect to the rotational direction, of a region where said endless belt is nipped between said second roller and said first rotatable member is longer than a length, with respect to the rotational direction, of a region where said endless belt is nipped between said first roller and said first rotatable member.

12. An image heating apparatus according to claim 7, wherein said first rotatable member contacts and heats an unfixed image as the image to fix the unfixed image on the recording material.

13. An image heating apparatus comprising:

first and second rotatable members configured to heat an image on a recording material at a nip therebetween;

an endless belt configured to heat said first rotatable member in contact with an outer surface of said first rotatable member; and first and second rollers configured to rotatably support said endless belt from an inside of said endless belt, wherein a heating area in which said first rotatable member is heated by said endless belt is formed from a position where said endless belt is pressed to said first rotatable member by said first roller to a position where said endless belt is pressed to said first rotatable member by said second roller along a rotational direction of said first rotatable member; and wherein a feeding force by which said endless belt is fed between said second roller and said first rotatable member is larger than a feeding force by which said endless belt is fed between said first roller and said first rotatable member.

14. An image heating apparatus according to claim 13, wherein with respect to the rotational direction of said first rotatable member, a length of a region where said endless belt is nipped between said second roller and said first rotatable member is shorter than a length of a region where said endless belt is nipped between said first roller and said first rotatable member.

15. An image heating apparatus according to claim 14, wherein said second roller is smaller in diameter than said first roller.

16. An image heating apparatus according to claim 13, further comprising a driving source configured to impart a rotational driving force to said second roller, wherein said first roller is rotated by rotation of said endless belt by the rotational driving force.

17. An image heating apparatus according to claim 13, further comprising an imparting mechanism configured to impart a rotational resistance to said first roller so that the rotational resistance is larger than a rotational resistance acting on said second roller.

18. An image heating apparatus according to claim 13, wherein said first rotatable member contacts and heats an unfixed image as the image to fix the unfixed image on the recording material.

19. An image heating apparatus comprising:

first and second rotatable members configured to heat an image on a recording material at a nip therebetween;

an endless belt configured to heat said first rotatable member in contact with an outer surface of said first rotatable member; and first and second rollers configured to rotatably support said endless belt and configured to urge said endless belt toward said first rotatable member, wherein said second roller is provided downstream of said first roller with respect to a rotational direction of said first rotatable member within said endless belt; and wherein a feeding force by which said endless belt is fed between said second roller and said first rotatable member is larger than a feeding force by which said endless belt is fed between said first roller and said first rotatable member, wherein the second roller presses against the first rotatable member through said endless belt.

20. An image heating apparatus according to claim 19, wherein with respect to the rotational direction of said first rotatable member, a length of a region where said endless belt is nipped between said second roller and said first rotatable member is longer than a length of a region where said endless belt is nipped between said first roller and said first rotatable member.

21. An image heating apparatus according to claim 20, wherein said second roller is smaller in diameter than said first roller.

22. An image heating apparatus according to claim 19, further comprising a driving source configured to impart a rotational driving force to said second roller, wherein said first roller is rotated by rotation of said endless belt by the rotational driving force.

23. An image heating apparatus according to claim 19, further comprising an imparting mechanism configured to impart a rotational resistance to said first roller so that the rotational resistance is larger than a rotational resistance acting on said second roller.

24. An image heating apparatus according to claim 19, wherein said first rotatable member contacts and heats an unfixed image as the image to fix the unfixed image on the recording material.

* * * * *